US010287140B2

(12) United States Patent
Grodaes

(10) Patent No.: US 10,287,140 B2
(45) **Date of Patent: *May 14, 2019**

(54) MOTORCYCLE ENGINE HOIST

(71) Applicant: Douglas Grodaes, Lacombe (CA)

(72) Inventor: Douglas Grodaes, Lacombe (CA)

( * ) Notice: Subject to any disclaimer, the term of this patent is extended or adjusted under 35 U.S.C. 154(b) by 34 days.

This patent is subject to a terminal disclaimer.

(21) Appl. No.: 15/490,844

(22) Filed: Apr. 18, 2017

(65) Prior Publication Data

US 2017/0217741 A1 Aug. 3, 2017

Related U.S. Application Data

(63) Continuation of application No. 14/641,429, filed on Mar. 8, 2015, now Pat. No. 9,656,837.

(60) Provisional application No. 61/949,252, filed on Mar. 7, 2014.

(30) Foreign Application Priority Data

May 15, 2014 (CA) ..... 2852559

(51) Int. Cl.
*B66C 23/48* (2006.01)

(52) U.S. Cl.
CPC ..... *B66C 23/485* (2013.01)

(58) Field of Classification Search
CPC . B66F 5/04; B66F 7/00; B66C 23/485; B66C 23/48; B66C 23/46; B66C 1/40; B66C 1/107
USPC ..... 254/2 B, 8 B, 8 R
See application file for complete search history.

(56) References Cited

U.S. PATENT DOCUMENTS

| | | | | | |
|---|---|---|---|---|---|
| 5,052,566 | A * | 10/1991 | Ziegler | B66C 23/48 | 212/257 |
| 5,188,247 | A * | 2/1993 | Jastrow | B66C 23/48 | 212/257 |
| 5,800,000 | A * | 9/1998 | Shockley | B66C 1/107 | 294/67.5 |
| 5,934,490 | A | 8/1999 | Mora | | |
| 8,596,627 | B2 * | 12/2013 | Lands | B25H 1/0007 | 254/2 B |
| 2003/0071003 | A1 | 4/2003 | Eaton | | |
| 2003/0098559 | A1 * | 5/2003 | Reese | B25H 5/00 | 280/32.6 |
| 2009/0304488 | A1 * | 12/2009 | Becker | B66C 1/40 | 414/739 |
| 2010/0283016 | A1 | 11/2010 | Drake | | |

* cited by examiner

*Primary Examiner* — Joseph J Hail
*Assistant Examiner* — Henry Y Hong
(74) *Attorney, Agent, or Firm* — Sander R. Gelsing

(57) ABSTRACT

An engine hoisting assembly for supporting an engine comprises a ground supporting frame, a substantially upright member having a longitudinal axis, a boom operably connected to the upright member, lifting means to selectively move the boom up or down along upright member's longitudinal axis and engine connecting means to operably connect the boom to the engine. The boom is maintained at a substantial horizontal orientation when lifting means selectively moves boom up or down.

14 Claims, 16 Drawing Sheets

MOTORCYCLE ENGINE HOIST

CROSS REFERENCE TO RELATED APPLICATION

This application is a continuation of co-pending U.S. application Ser. No. 14/641,429, which was filed on Mar. 8, 2015, entitled "MOTORCYCLE ENGINE HOIST" and which was a regular application of, and claims the benefit of, U.S. Provisional Patent Application No. 61/949,252 filed Mar. 7, 2014 and entitled, "MOTORCYCLE ENGINE HOIST", the entirety of each of which are incorporated herein by reference for all purposes.

FIELD OF THE INVENTION

The present invention relates generally to the field of engine hoist devices and, more particularly, to an engine hoist apparatus for removing, performing work on and reinstalling an engine of a motorcycle.

BACKGROUND OF THE INVENTION

The background information discussed below is presented to better illustrate the novelty and usefulness of the present invention. Except where indicated, this background information is not admitted prior art.

One of the biggest issues for motorcycle enthusiasts and motorcycle mechanics, when servicing or rebuilding their engines, is getting the heavy engines out of the motorcycles. Motorcycle engines commonly weigh as much as 250 lbs or more. Often, a motorcycle owner's manual states that it takes three (3) men to lift a motorcycle engine out from the motorcycle's frame. Conventional automotive engine floor hoists are not suitable for motorcycle engines because such hoists are designed to remove engines upward out of the automobile's engine compartment. In the case of motorcycles, engines cannot be moved upwards, because that direction is blocked by the motorcycle's frame, gas tank and seat. Moreover, in most motorcycles, there is typically only a few inches of clearance between the top of the engine and motorcycle's frame portion that is located above the engine. As such, motorcycle engines are generally removed from the motorcycle in a generally lateral fashion.

In cases where one cannot find additional manpower to lift an engine out of a motorcycle, a popular way to accomplish removal of the engine alone is as follows. First, the various components and parts are removed from the motorcycle as much as possible, to lighten the overall motorcycle. Then the engine/motor mounts are removed or loosen. The motorcycle is then slowly tilted on its side, allowing the engine to gently rest on the floor or ground surface. Once the engine is supported by the ground, the motorcycle and its frame are lifted back up, thereby leaving the engine supported by the ground surface and free to work on. However, this practice is time consuming (especially the first part of removing various components and parts from the motorcycle), risks damaging the engine and motorcycle during the tilting stage, such as if the motorcycle is accidentally dropped on its side and creates safety concerns (such as being pinned or trapped underneath the motorcycle).

Therefore, what is needed is an apparatus, device or assembly to easily, reliably and safely move a motorcycle engine in and out of its frame.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1:
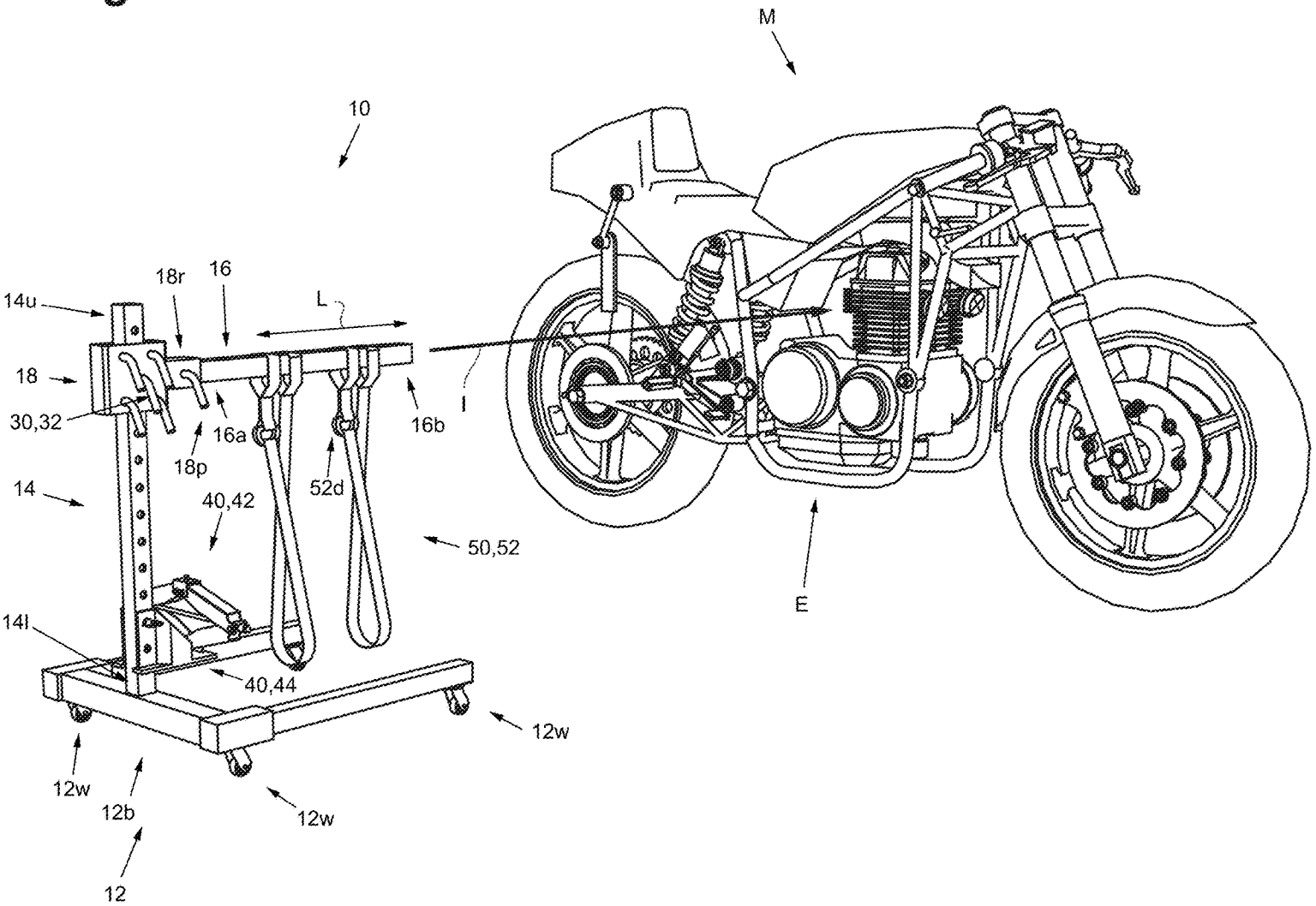
FIG. 1 is a perspective view of a preferred embodiment of the invention, shown adjacent a motorcycle.

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

In accordance with a preferred embodiment of the present invention, and as shown generally in FIGS. 1-10, there is a provided an engine hoisting assembly 10 for supporting, lifting and lowering an engine E as may be desired. Engine hoisting assembly 10 is preferably for use with a vehicle such as a motorcycle M wherein engine E is mounted within the motorcycle's frame F. Although the assembly 10 is illustrated for use with a motorcycle M, the assembly 10 will work equally well with other types of vehicles wherein an engine is typically moved laterally out of the vehicle's frame. For example, the assembly 10 will work with garden tractors, tricycles, quads and even riding lawn mowers.

In the preferred embodiment the engine hoisting assembly 10 comprises a ground supporting frame 12, a substantially vertical or upright member or post 14 having a longitudinal axis LA, a substantially horizontal member or boom 16 operably connected to upright member, lifting means 40 to selectively move boom 16 up or down and engine connecting means 50 to operably connect boom 16 to, and support therefrom, an engine E. Preferably, boom 16 is an elongate member with a longitudinal axis L having two ends 16*a*, 16*b*, wherein one end 16*a* is operably connected to upright member 14 and the other end 16*b* can be easily inserted, at least partially, within motorcycle engine frame F above engine E (see FIG. 5). More preferably, boom 16 is of sufficient length (i.e. has a sufficiently long longitudinal axis L) so that, when positioned within frame F above at least a portion of the engine E, it extends completely over top of said engine E from one lateral side of the engine E to the other side. Preferably, the boom 16 has a length in the range of 18 to 36 inches. More preferably, and for typical motorcycle engine as illustrated in the figures, boom 16 has a length in the range of 26 to 32 inches. Advantageously, with a boom 16 sufficiently long to extend over substantially all of engine E from one side to the other, it will be easier to use engine connecting means 50 to support the engine E from the boom 16. More advantageously, by not making boom 16 excessively long, the assembly 10 will be easy to move and manipulate into position adjacent the motorcycle M.

As can be seen in the figures of the preferred embodiment, ground supporting frame 12 supports upright member 14, which projects substantially vertically therefrom. Ground supporting frame 12 preferably has a forked base 12*b* and a plurality of wheels or casters 12*w* to facilitate mobility of the engine hoisting assembly 10. In the preferred embodiment of FIGS. 1-10, one end 16*a* of the boom 16 is slidably mounted to upright member 14 for slidable movement therealong and boom 16 is maintained at a substantial horizontal orientation when lifting means 40 selectively moves boom 16 (see FIGS. 5-6). Advantageously, by keeping boom 16 at a substantial horizontal orientation, free end 16*b* of boom 16 can be easily inserted into, and moved within, motorcycle engine frame F above engine E without jamming against a portion of the frame F or engine E, as is the case with traditional engine hoists wherein the boom element pivots at one end. In other embodiments (not shown), boom 16 may be operably connected to upright member in some other fashion, such as through a linkage, wherein the longitudinal axis L of boom 16 is maintained at a substantial horizontal orientation when lifting means 40 selectively moves boom 16 up or down.

In the preferred embodiment of FIGS. 1-10, engine connecting means 50 comprises at least one tensile member, such as an adjustable strap 52 having D-rings 52*d*. In other embodiments (not shown), the engine connecting means 50 comprises a ratchet strap or a metal chain. Engine connecting means 50 operably connect boom 16 to engine E so as to allow boom 16 to carry and support the full weight of the engine E, such as by having said one or more adjustable straps 52 wrap around select portions of the engine E and also connect to, or warp around boom 16 (see, for example, FIGS. 5-7). Preferably, adjustable straps 52 are substantially flat, to facilitate use of said straps 52 to connect engine E to boom 16 in tight space constraints that may be present when engine E is within frame F. Advantageously, the assembly 10 of the embodiment of FIGS. 1-10 allows for connection to a motorcycle engine E, even when there are only a few inches of clearance between the top of the engine E and motorcycle's frame F.

Preferably, the various components of the invention 10, such as the base 12, upright member 14 and boom 16, are made of metal, steel or any other suitable material that provides adequate strength, durability and rigidity to support the various loads that may be encountered by the engine hoisting assembly 10. Upright member 14 may be welded to base 12 or fastened to base 12 in another suitable conventional manner.

In the preferred embodiment of FIGS. 1-10, upright member 14 has an upper end 14*u* and a lower end 14*l*, with lower end being supported by frame 12. Boom 16 is slidably mounted to upright member 14 for slidable movement therealong, i.e. between upper and lower ends 14*u*, 14*l*. Preferably, boom 16 is slidably mounted to upright member 14 via a sliding member 18. More preferably, sliding member 18 further comprises receiver portion 18*r* to receive one end 16*a* of boom 16 therein. Even more preferably, a removable retaining pin 18*p* and corresponding orifices 18*ro*, 16*ro* through receiver portion 18*r* and end 16*a* are provided for secure location of the boom 16 within the receiver portion 18*r* in a conventional manner. Advantageously, by utilizing a receiver portion 18*r*, booms of different sizing and shapes may be interchanged onto sliding member 18 (see, for example, boom 16' in FIG. 9). More advantageously, by utilizing a receiver portion 18*r*, boom 16 may be removed from assembly 10 so as to allow assembly 10 to disassemble for more compact storage or shipping. In other embodiments (not shown), boom 16 may be welded to sliding member 18 or fastened to said member 18 in another suitable conventional manner.

Figure 2:
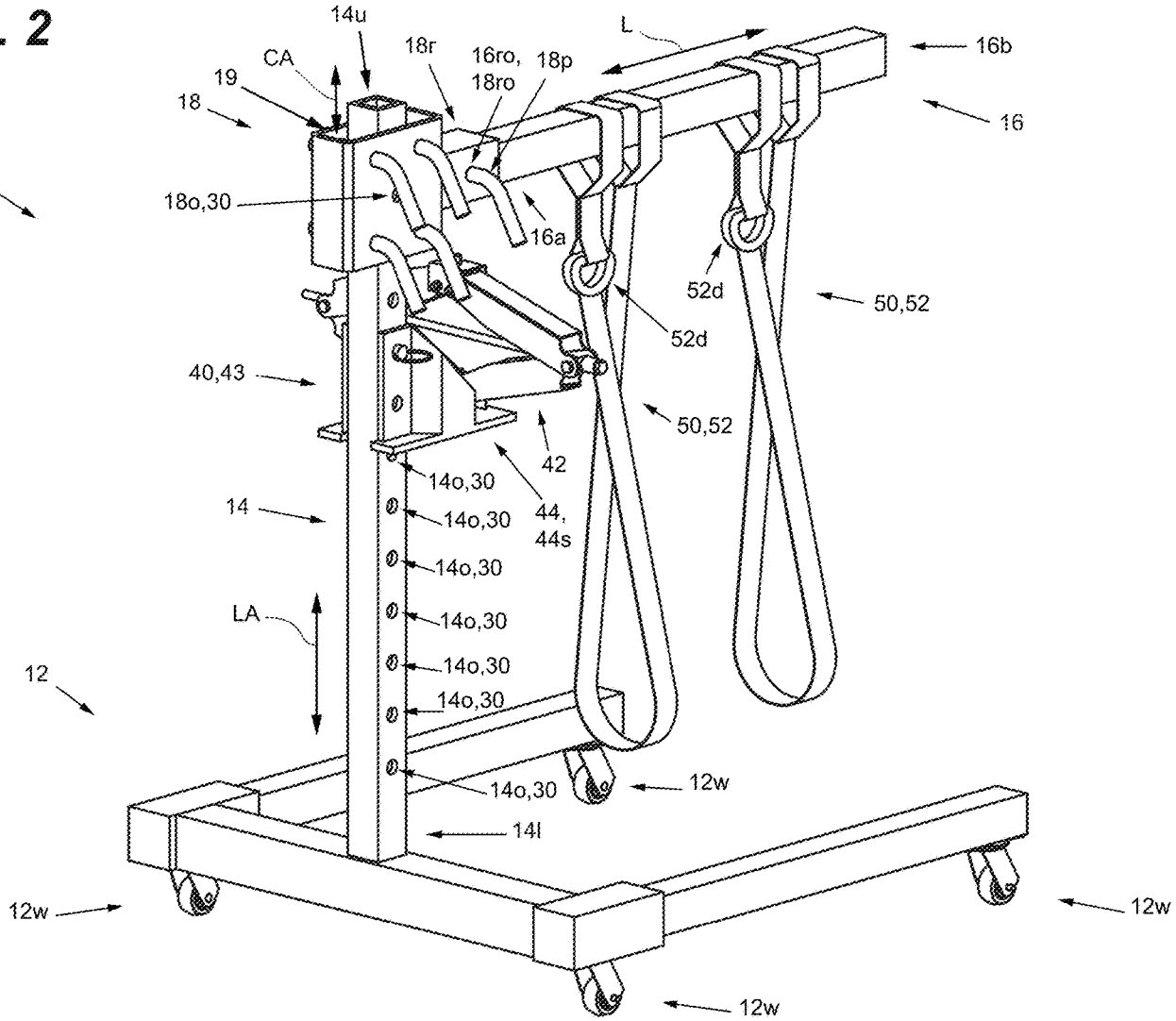
FIG. 2 is a perspective view of the embodiment of FIG. 1.
Figure 10:
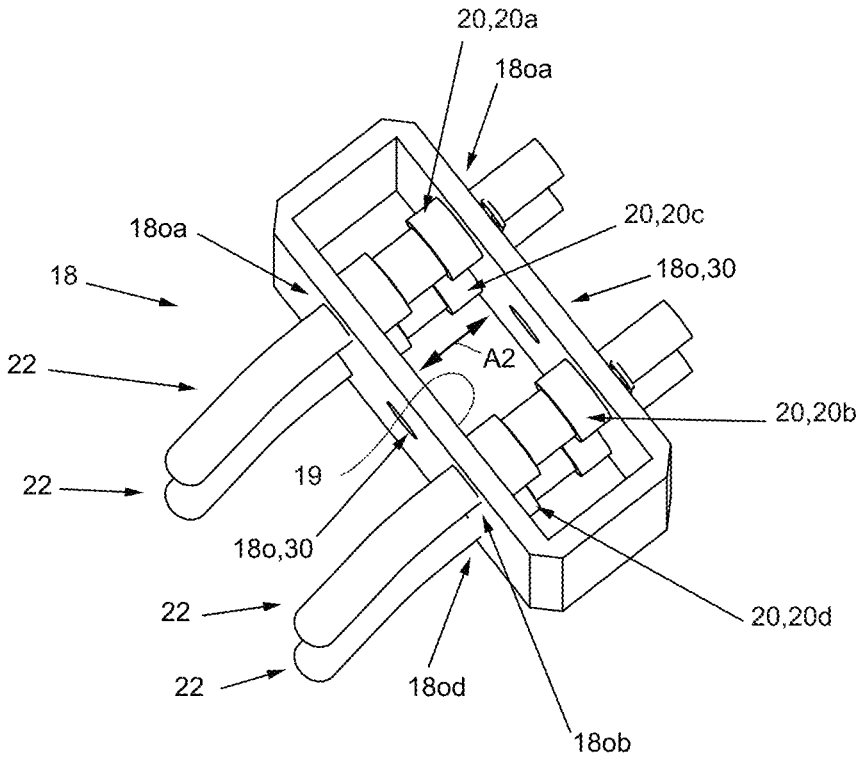
FIG. 10 is a perspective view of the interior of the sliding member of the embodiment of FIG. 1 (receiver portion not shown), illustrating the rollers disposed within.

Sliding member 18 has a central passage 19 through which upright member 14 may pass (see FIGS. 2 and 10). Preferably, central passage 19, has a central passage axis CA to slidably receive upright member therealong. Sliding member 18 preferably has a plurality of bearings, bushings or rollers 20 disposed within central passage 19 to rollably receive upright member therebetween and facilitate sliding movement of sliding member 18 along the upright member 14. Advantageously, rollers 20 facilitate sliding movement of the sliding member 18 and boom 16 when the assembly 10 is loaded with the weight of an engine E. Preferably, there are four rollers 20 disposed within central passage 19 in a pair-wise arrangement, with an upper pair 20*a*, 20*b* positioned substantially above lower pair 20*c*, 20*d*, as more clearly shown in FIG. 10. More preferably, rollers 20 are removably secured in proper placement within central passage 19 by removable roller retaining pins 22 insertable through sliding member 18 via paired corresponding sliding member orifices 18*oa*, 18*ob*, 18*oc*, 18*od*, said rollers 20 preferably having an internal passage of suitable diameter to accept a retaining pin 22 therethrough. Alternatively, in another embodiment (not shown), retaining pins may incorporate roller, bushing or bearing components within them. Advantageously, rollers 20 may be removed for servicing by pulling pins 22 from sliding member 18. More advantageously, the angle of sliding member 18, relative to upright member 14, and any boom 16 attached thereto, may be adjusted by pulling or removing one or more of the retaining pins 22 (see FIG. 3 for example).

Preferably sliding member securing means 30 are provided to securely maintain sliding member 18 (and hence boom 16 and any load carried by boom) at one or more desired preset locations vertically along upright member 14. In the preferred embodiment of the assembly 10, securing means 30 comprises: (i) a plurality of upright member orifices 14*o* positioned at regular intervals along upright member 14, substantially between upper and lower end 14*u*, 14*l* (see FIG. 2), (ii) a central orifice 18*o* having an axis A2 through substantially the center of sliding member 18 and (iii) a removable security retaining pin 32. The plurality of orifices 14*o* positioned at regular intervals along upright member 14 substantially correspond to the desired preset locations. The plurality of orifices 14*o* preferably have an axis A1 that is substantially perpendicular to the longitudinal axis LA of the upright member 14 (e.g. see FIG. 12). Sliding member 18 may be retained at a desired preset location along upright member 14 by aligning central orifice 18*o* with one of the orifices 14*o* (and preferably by also aligning axis A1 with axis A2) in upright member 14 and then placing removable retaining pin 32 through both orifices 14*o*, 18*o* to selectively and securely maintain the sliding members 18 position along (see, for example, FIG. 3). Advantageously, in addition to securely maintain sliding member 18 (and hence boom 16) at one or more preset locations vertically along upright member 14, retaining pin 32 can also function as a pivot pin for sliding member 18 and boom 16 when retaining pins 22 and rollers 20 are removed (see FIGS. 3, 11*a*, 11*b* and 12 for example).

Preferably, lifting means 40 further comprises a jack 42 and a jack base member 44. Jack base member 44 supports jack 42 and is selectively, securably positionable along upright member 14 at one or more desired preset locations vertically along upright member 14 (see, for example FIG. 5 where jack 42 and jack base member 44 are positioned near the upper end 14*u* of upright member 14). Advantageously, lifting means 40 may be quickly positioned along upright member 14 at a desired vertical location; e.g. a location that substantially corresponds to a vertical location where boom 16 will be positioned above an engine E of a particular motorcycle M or other vehicle. Jack 42 is illustrated as a scissor-type jack, but jack could also be another type of suitable jack, such as a hydraulic jack. In another embodiment (not shown), jack 42 may be hydraulic cylinder-type jack mounted directly to jack base member 44 (rather than merely being supported by jack base member 44).

Jack 42 and jack base member 44 cooperate to selectively move boom 16 up or down along upright member 14. In the preferred embodiment of FIGS. 1-10, jack 42 and jack base member 44 are disposed along upright member 14 at a position below boom 16 and sliding member 18, with jack 42 engaging a lower surface of boom 16 (or of sliding member 18) at an interface IF (see FIGS. 5-9). Preferably the interface IF is between jack 42 and a lower surface of the receiver portion 18*r* of sliding member 18 (see FIGS. 8-9). Jack 42 may be actuated in a conventional manner to raise (or lower) boom 16 and/or sliding member 18—compare FIG. 5 to FIG. 6 which illustrate jack 42 raising sliding member 18, boom 16 and engine E attached to boom (the raising action being indicated by arrows labeled U). Advantageously, jack 42 may be actuated to selectively move boom 16 and/or sliding member 18 so as to: (i) make fine adjustments to boom's location above engine E in a particular motorcycle M and/or (ii) lift engine E from the frame F once boom 16 is connected to engine using the engine connecting means 50 (see FIG. 6). More advantageously, by having jack 42 engage at sliding member 18 (and, hence, also at boom 16 adjacent end 16*a*), and by having sliding member 18 slide along upright member 14 via rollers 20 disposed in central passage 19, boom 16 is maintained at a substantial horizontal orientation when lifting means 40 selectively moves boom 16 along upright member 14.

In the preferred embodiment of the assembly 10, jack base member 44 may be secured at a desired preset location via jack base securing means 43. In the preferred embodiment of FIGS. 1-10, jack base securing means comprises (i) the plurality of upright member orifices 14*o* positioned at regular intervals along upright member 14, (ii) one or more base member orifices 44*o* through the jack base member 44 and (iii) a base member retaining pin 44*p*. The plurality of orifices 14*o* positioned at regular intervals along upright member 14 substantially correspond to the desired preset locations. Jack base member 44 may then be retained at a desired preset location along upright member 14 by aligning one of orifice 44*o* with one of the orifices 14*o* in upright member 14 and then placing base member retaining pin 44*p* through both orifices 14*o*, 44*o* to selectively and securely maintain the jack base member's 44 position along (see, for example, FIGS. 4*a*-4*c*). Advantageously, lifting means 40 may be quickly and securely positioned along upright member 14 at a desired vertical location by removing base member retaining pin 44*p*, moving base member 44 to the desired position and inserting pin 44*p* through orifice 44*o* and corresponding orifice 14*o*.

Figure 4A:
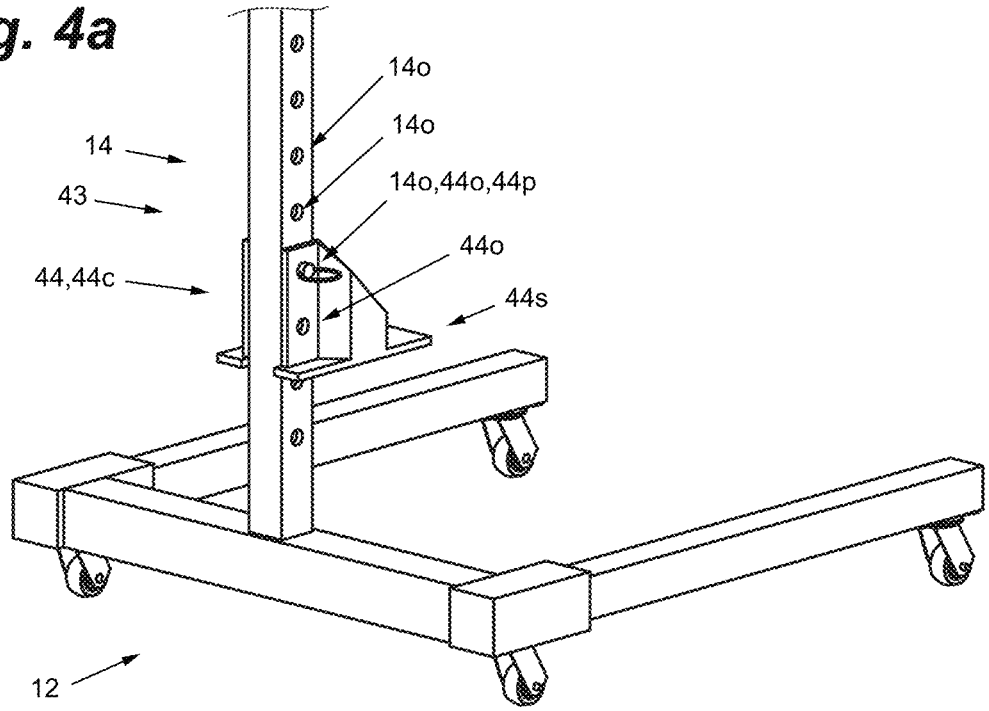
FIGS. 4*a*-4*c* are perspective views of the lower portions of embodiment of FIG. 1, illustrating the different orientations of the jack base member.
Figure 4B:
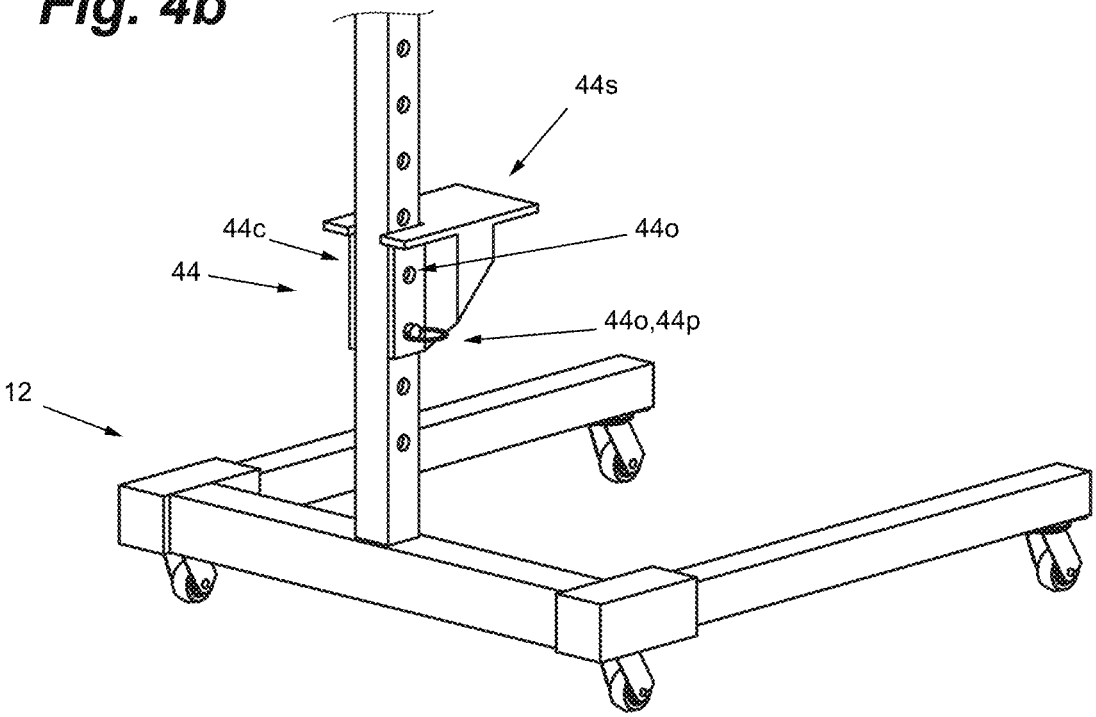
Figure 4C:
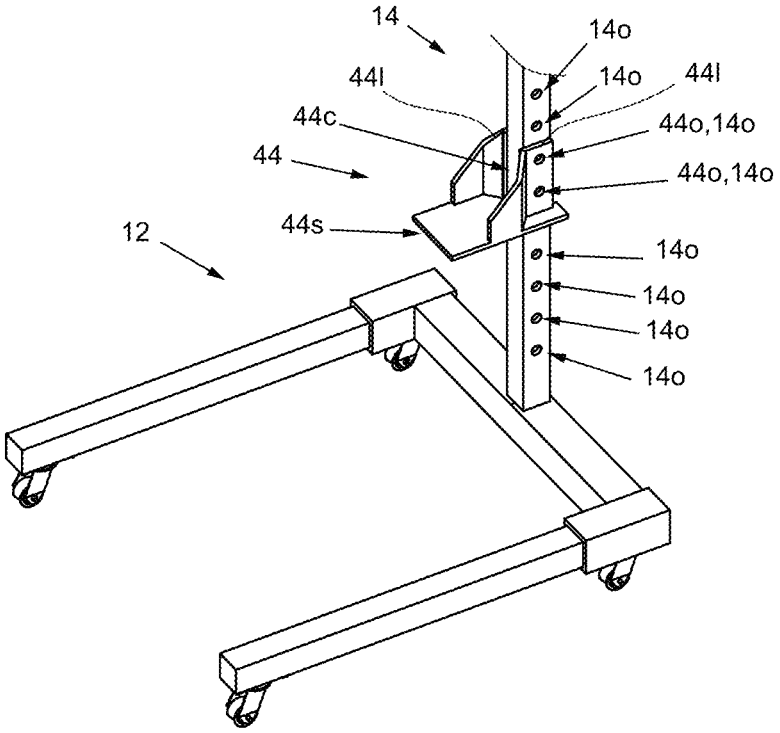
Figure 5:
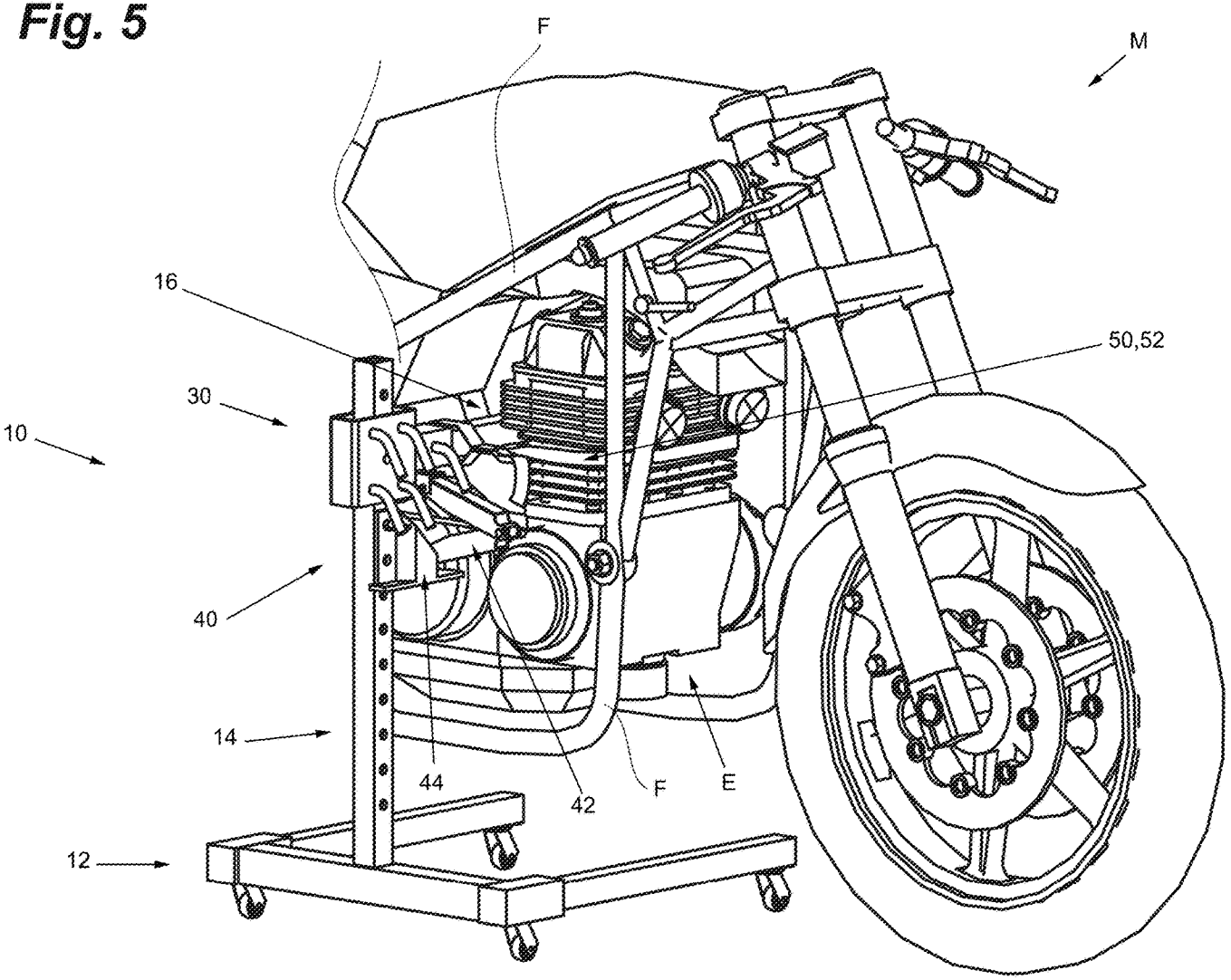
FIGS. 5-7 are perspective views of the embodiment of FIG. 1 being utilized to lift and remove an engine from a motorcycle.
Figure 6:
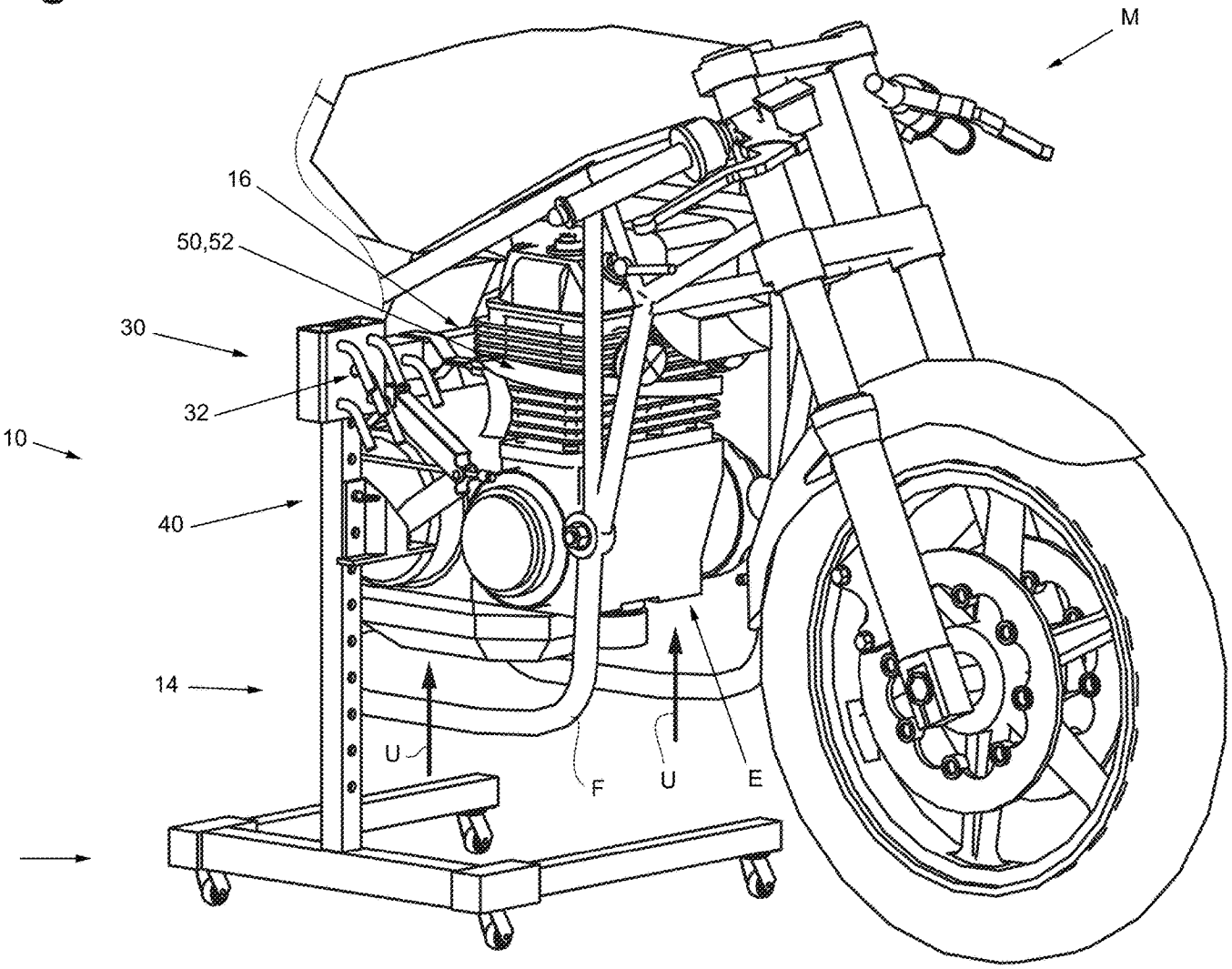
Figure 7:
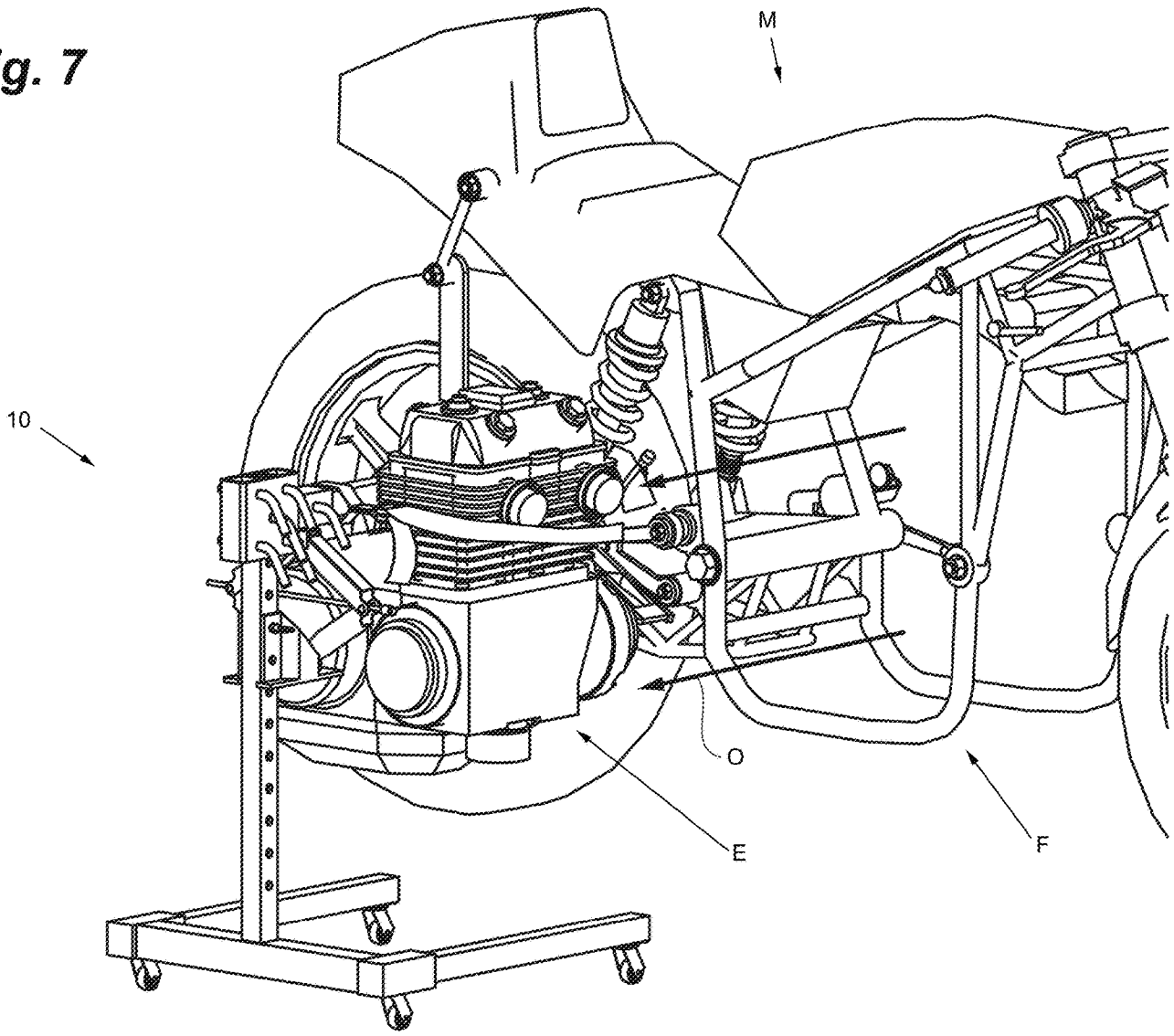

In the preferred embodiment of the assembly 10, jack base member 44 further comprises a pair of later member 44*l* which create a base member channel or groove 44*c* therebetween (see FIG. 4*c*). In this embodiment, each of the lateral members 44*l* has at least one base member orifice 44*o* of suitable dimensions to allow base member retaining pin 44*p* to pass therethrough (and through an orifice 14*o* in the upright member 14) so as to retain jack base member 44 at a desired location. The base member channel 44*c* is of sufficient dimensions to allow jack base member 44 to slidably engage upright member 14 and to slide therealong. Preferably, jack base member 44 has a substantially horizontally projecting jack support surface or ledge 44*s* upon which jack 42 can be securely placed and supported (see FIGS. 2 and 4*c*). More preferably, lateral members 44*l* and channel 44*c* allow for jack base member 44 (and jack support surface 44*s*) to be placed in more than one orientation along upright member—compare FIG. 4*a* with FIG. 4*b*. Advantageously, jack base member 44 (and jack support surface 44*s*) may be placed in a particular orientation (along upright member 14) that most closely corresponds to a desired location, so as to allow quick placement of boom 16 above an engine E—thereby only requiring a user to actuate jack 42 a minimal amount to make fine adjustments to boom's location above engine E in a particular motorcycle M.

FIGS. 1 and 5-7 illustrate the embodiment of the assembly 10 being utilized to lift and remove an engine E from a motorcycle M. The boom 16 of the assembly 10 may be moved to a desired preset location along upright member 14 so that boom 16 will be substantially above at least a portion of the engine E when assembly 10 is moved toward motorcycle M (see FIG. 1). Sliding member securing means 30, such as security retaining pin 32, may be used to maintain boom 16 at the desired preset location. Assembly 10 may then be moved inwards I towards the motorcycle M so that boom 16 is positioned substantially above at least a portion of the engine (see FIGS. 1 and 5). Sliding member securing means 30 (and pin 32) may then be disengaged (e.g. pin 32 removed) so that boom 16 and sliding member 18 are instead supported by lifting means 40 (see FIG. 5). Engine connecting means 50 can then be used to operably connect engine 50 to boom 16 (see FIG. 5).

Once the engine E is supported by boom 16 and engine connecting means 50, any engine mounting bolts (not shown) that normally maintain engine E mounted to frame F can be loosened and removed (along with any other components that may need to be disconnected to allow engine E to be removed from frame). Lifting means 40 can then be utilized to lift boom 16 and, hence, engine E upwards U (see FIG. 6). Engine E typically only needs be lifted upwards U a small amount to clear the various frame F portions (e.g. clear the lower portions of the frame F), i.e. so as to allow lateral removal of engine E from the frame F; in normal applications, this is only an upward movement U of an inch or two—i.e. just before the engine E will hit the upper portion of frame F. Sliding member securing means 30 (and pin 32) may then be engaged so that boom 16, sliding member 18 and, now, engine E will all be supported by sliding member securing means 30 (see FIG. 6). Assembly 10, and engine E, may then be easily moved laterally outward O from motorcycle M and frame F; especially if ground supporting frame 12 has wheels or casters 12*w* (see FIG. 7).

Once the engine E is removed from the motorcycle M and supported by engine hoisting assembly 10, the engine E can be repaired or otherwise worked on while supported by assembly 10. If desired, engine E may be lowered (e.g. to the ground), by: (i) disengaging sliding member securing means 30, (ii) lowering jack 42 so as to place sliding member 18 at a next lower desired preset location vertically along upright member 14, (iii) re-engaging sliding member securing means 30 at such next lower desired preset location, (iv) releasing jack 42 from boom 16 or sliding member 18 and lowering lifting means 40 to a next lower position along upright member 14, (v) re-engaging jack 42 to boom 16 or sliding member 18, and then repeating steps (i) and (v) so as to lower engine E in an inch-worm fashion. Similarly, engine E maybe be raised by reversing the above-noted steps.

Figure 8:
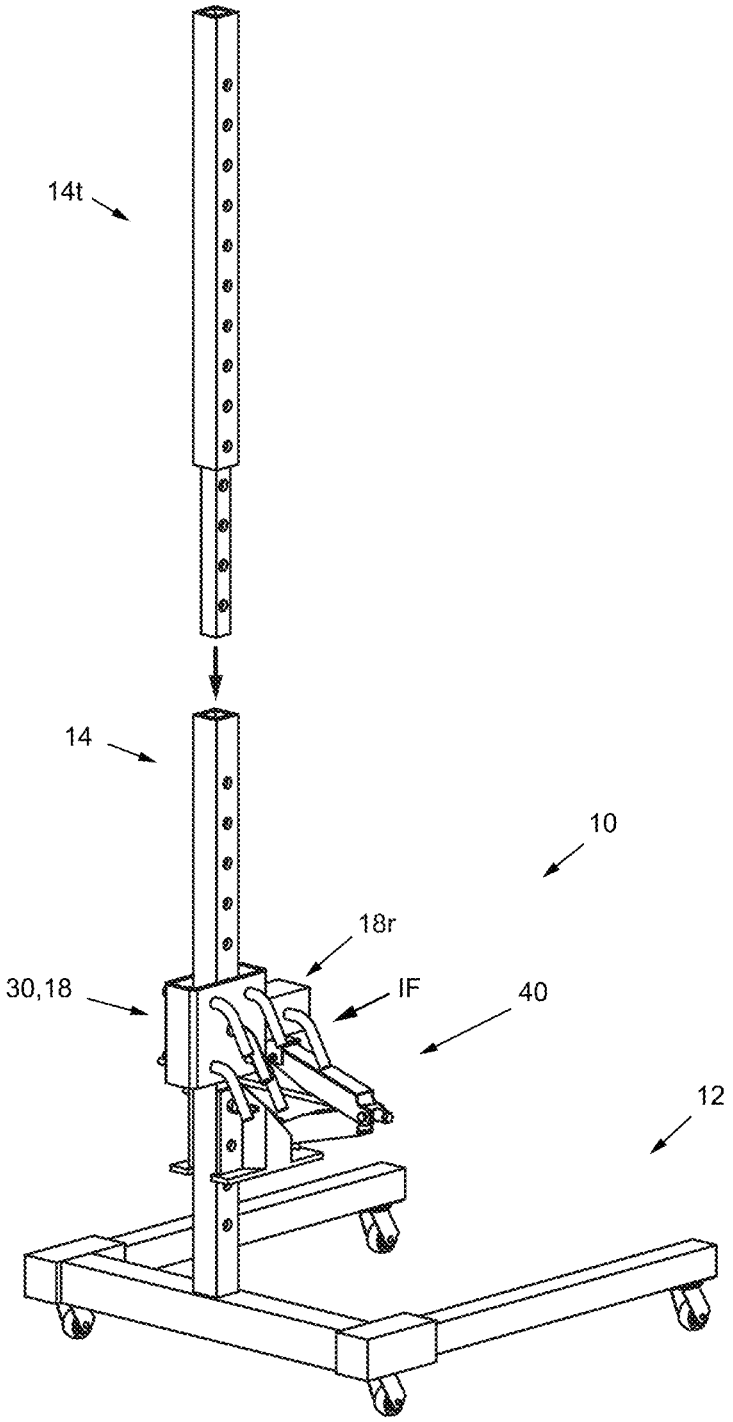
FIGS. 8-9 are perspective views of the embodiment of FIG. 1 with an optional tray attachment.
Figure 9:
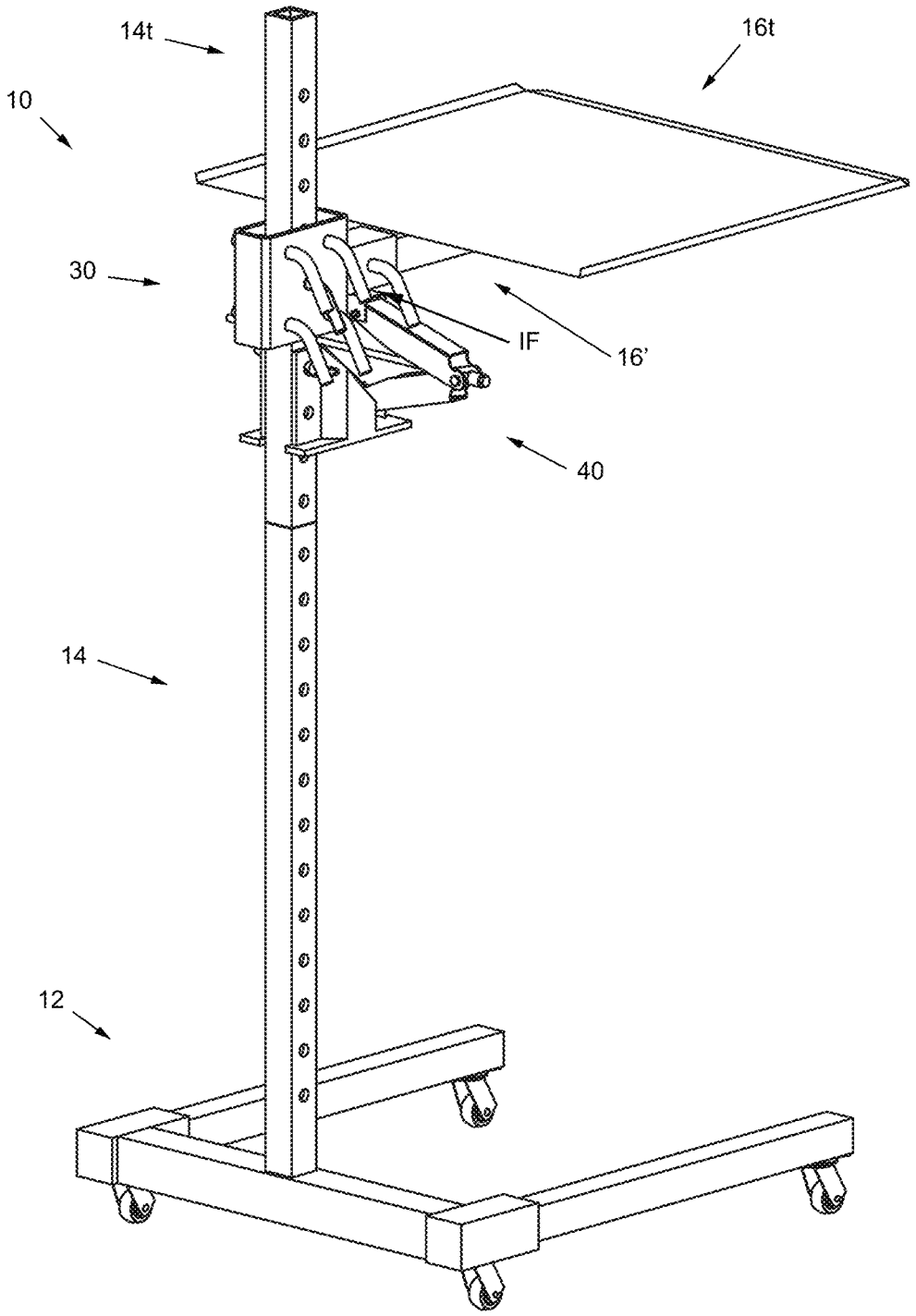

FIGS. 8-9 are perspective views of the embodiment of FIG. 1 illustrating an optional extension member 14*t*, to be received by and extend the upright member 14, and an optional tray attachment 16*t* on boom 16'. Advantageously, extension member 14*t* allows the assembly 10 to raise an engine E supported by boom 16 to greater heights, so as to allow easy placement of engine E on a work bench, table or the back of a pickup truck. More advantageously, tray attachment 16*t* can be utilized to allow assembly 10 to act as a work bench when assembly 10 is not being used as a hoist.

Additional Embodiment

Another preferred embodiment of an engine hoisting assembly 10 is shown generally in FIGS. 11*a*-14. This embodiment is similar to the embodiment shown in FIGS. 1-10 and comprises a ground supporting frame 12, a substantially vertical or upright member or post 14, a substantially horizontal member or boom 16 operably connected to upright member, sliding member 18, sliding member securing means 30, lifting means 40 to selectively move boom 16 up or down and engine connecting means (not shown in FIGS. 11*a*-14, but shown in FIGS. 1-2 and 5-7) to operably connect boom 16 to, and support therefrom, an engine.

Like the embodiment of FIGS. 1-10, boom 16 in the embodiment of FIGS. 11*a*-14 is an elongate member with a longitudinal axis L having two ends 16*a*, 16*b*, wherein one end 16*a* is operably connected to upright member 14 and the other end 16*b* can be easily inserted, at least partially, within motorcycle engine frame F above engine E. Boom 16 of the embodiment of FIGS. 11*a*-14 is slidably mounted to upright member 14 via sliding member 18 which further comprises receiver portion 18*r* to receive one end 16*a* of boom 16 therein. Sliding member 18 of this embodiment has a central passage 19 through which upright member 14 may pass (see FIGS. 12, 13*a* and 13*b*).

Unlike the embodiment shown in FIGS. 1-10, roller retaining pins are replaced with roller pins 24, which themselves roll or rotate against upright member 14. Roller pins 24 insertable through sliding member 18 via paired corresponding sliding member orifices 18*oa*, 18*ob*, 18*oc*, 18*od*. Preferably, roller pin bearings 25 are provided, at each of said paired corresponding sliding member orifices 18*oa*, 18*ob*, 18*oc*, 18*od*, to rollably support roller pins 24. More preferably, a bearing boss 26 is provided to maintain each roller pin bearing 25 adjacent its corresponding sliding member orifices (18*oa*, 18*ob*, 18*oc* or 18*od*), thereby allowing bearing 25 and roller pin 24 mounted therethrough to easily rotate when sliding member 18 is moved along upright member 14; see FIGS. 13*a* and 13*b*. Even more preferably, bearing bosses 26 are welded (or otherwise fastened) into place at their corresponding positions on the outside surface of the sliding member (see FIGS. 13*a*, and 13*b*). Yet even more preferably the inside diameter opening of sliding member orifices 18*oa*, 18*ob*, 18*oc*, 18*od* is slightly larger than the outside diameter of roller pins 24, thereby allowing for bearings 25 (and bearing bosses 26) to fully support roller pins 24 and their rotation, as sliding member 18 moves along upright member 14.

Advantageously, because the pins (i.e. roller pins 24) now rotate against upright member 14 and the bearings 25 are maintained in place on the outside of sliding member 18 (via bosses 26), it is easy to remove said pins 24 of this embodiment as compared to pins 22 in the embodiment of FIGS. 1-10—because in the embodiment of FIGS. 1-10 removal of pins 22 also meant that rollers (20, 20*a*-20*d*) would be released; said rollers 20 then likely falling downward and out from inside sliding member. More advantageously, using bearing bosses 26 allows for bearings 25 to be sealed bearings (as compared to perhaps having to use grease on rollers 20 within interior of sliding member 18, as in the embodiment of FIGS. 1-10).

Figure 3:
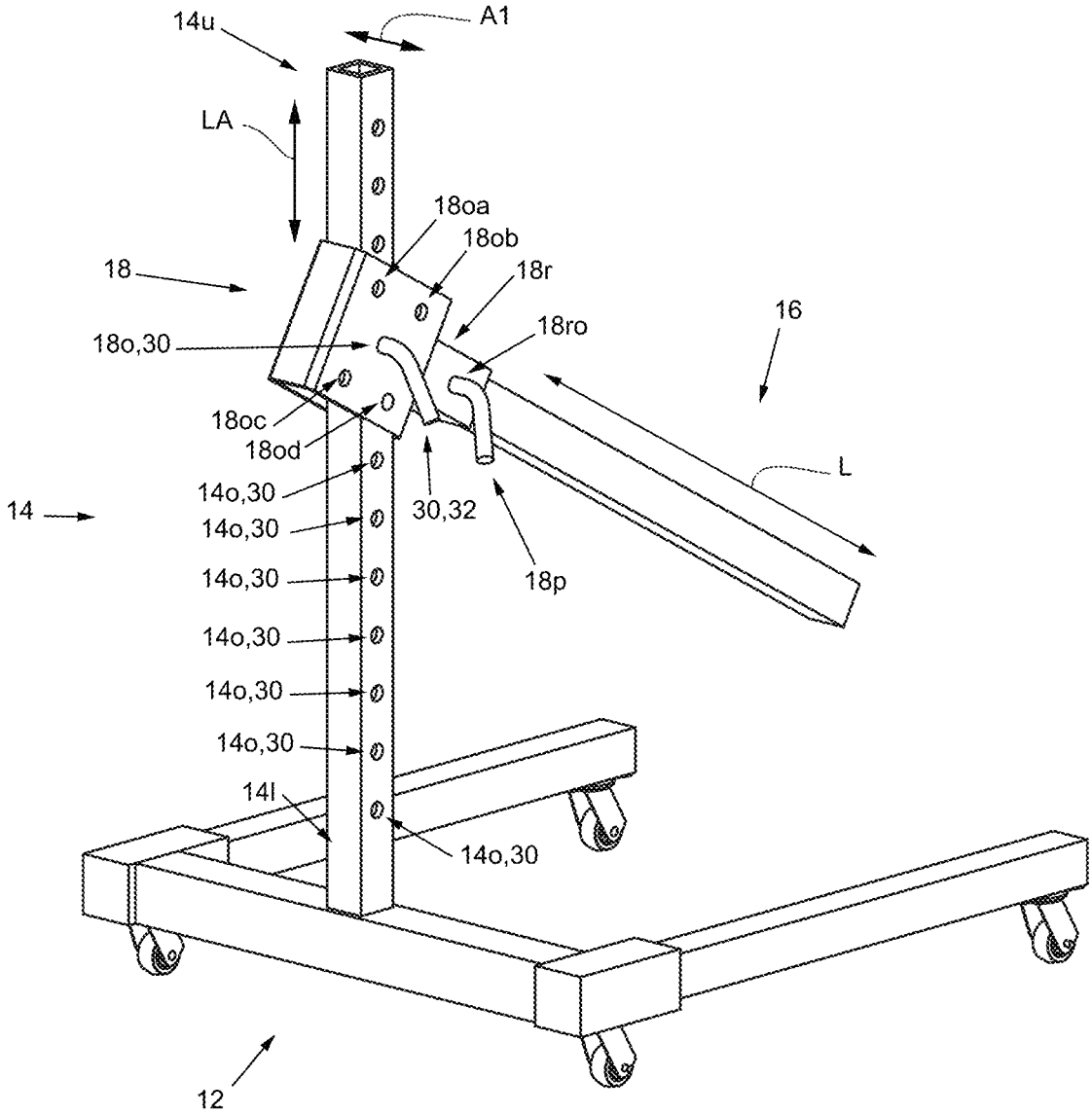
FIG. 3 is a perspective view of portions of the embodiment of FIG. 1, illustrating pivotal movement of the first section relative to the second section.
Figure 11A:
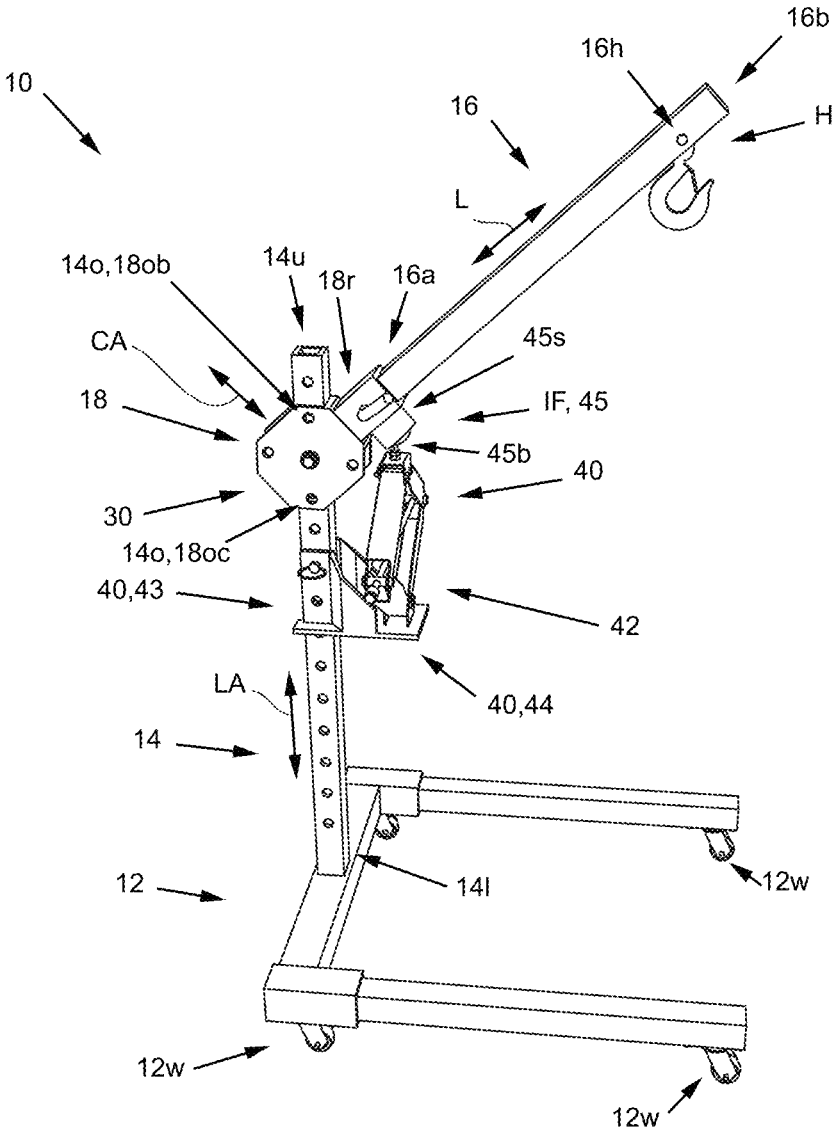
FIG. 11*a* is a perspective view of another embodiment of the invention.
Figure 11B:
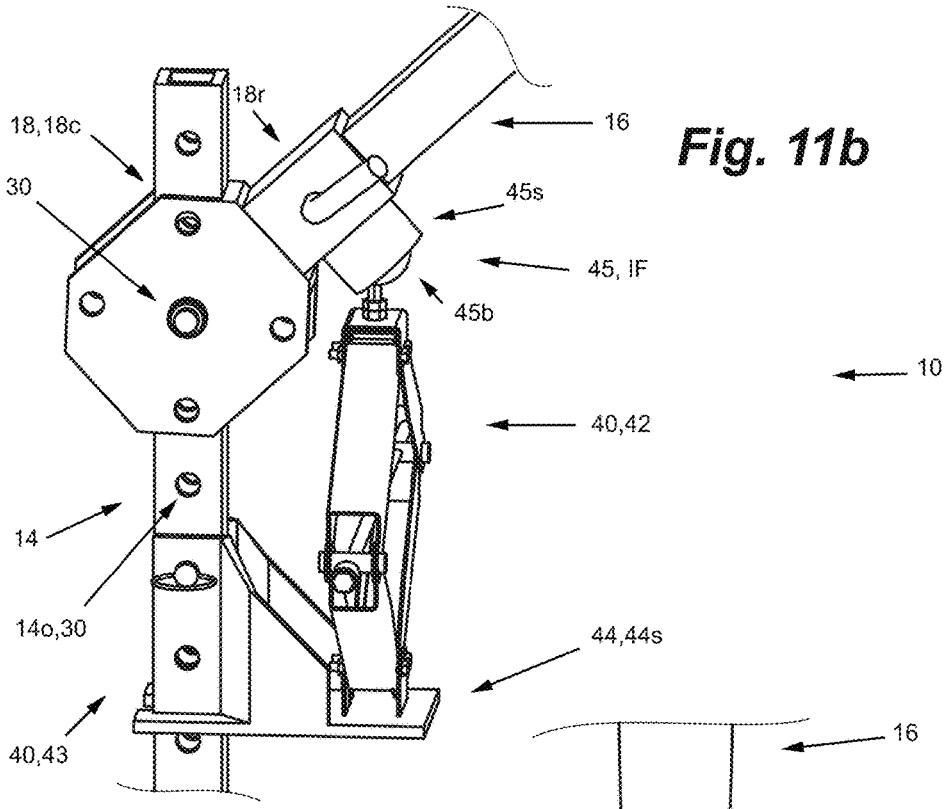
FIGS. 11*b*-11*c* are close-up perspective views of the lifting means of the embodiment of FIG. 11*a;*
Figure 11C:
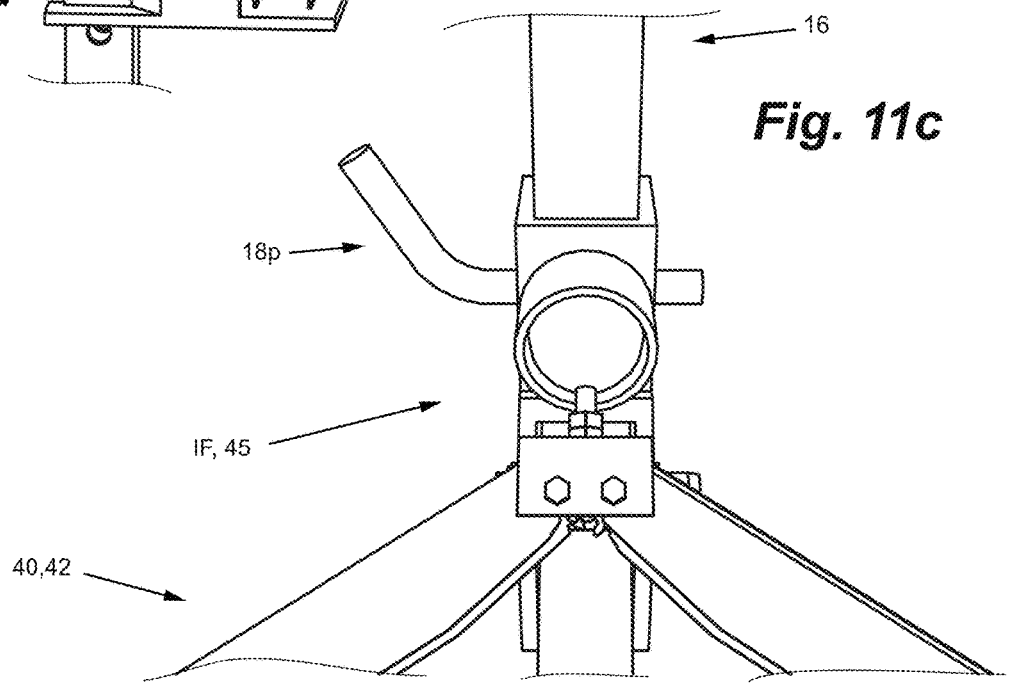
Figure 12:
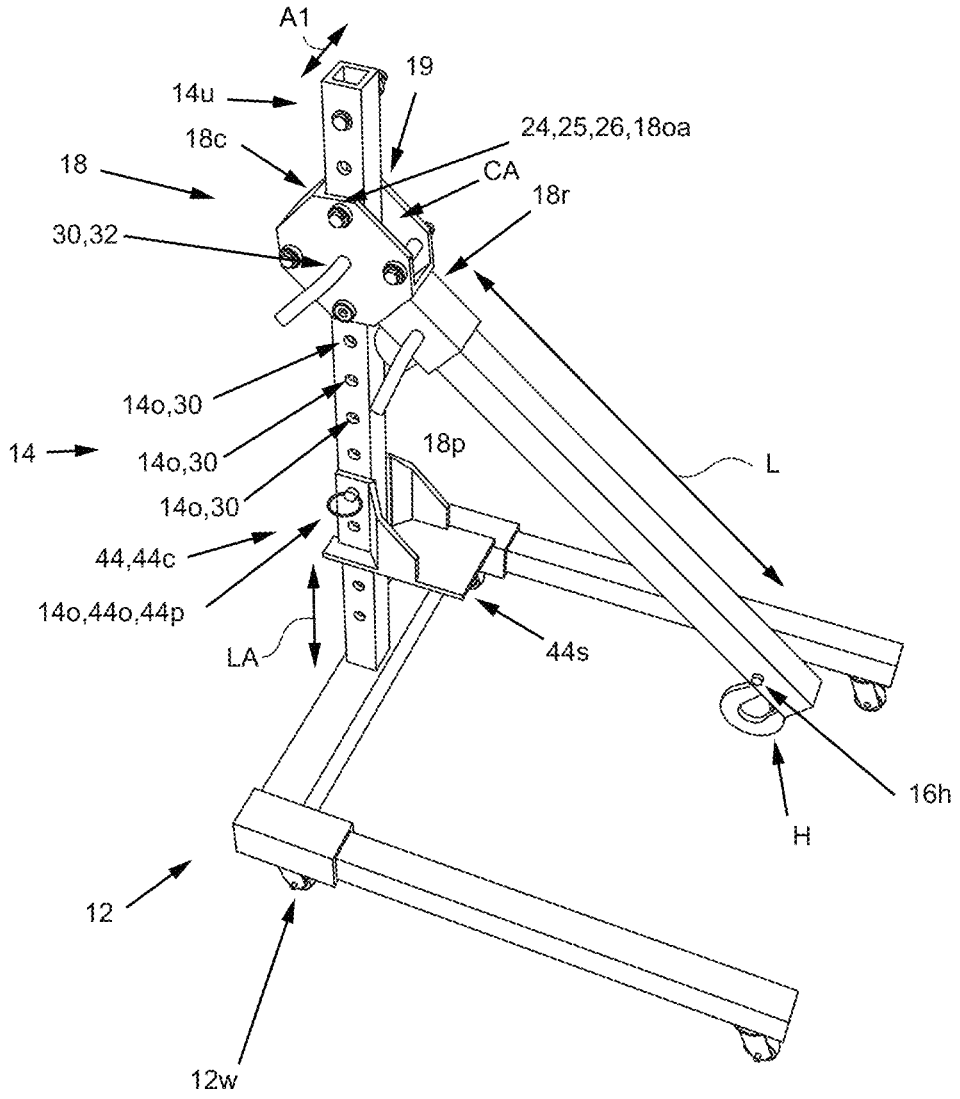
FIG. 12 is a perspective view of portions of the embodiment of FIG. 11*a*, illustrating pivotal movement of the first section relative to the second section.
Figure 13A:
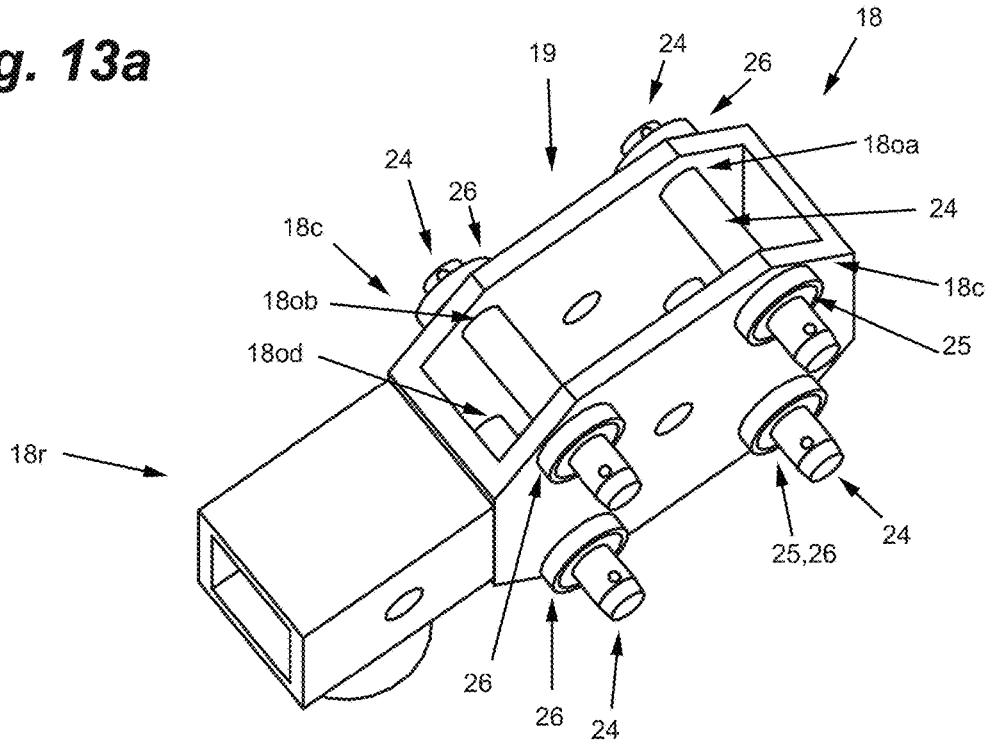
FIGS. 13*a*-13*b* are close-up perspective views of the sliding member of the embodiment of FIG. 11*a*.
Figure 13B:
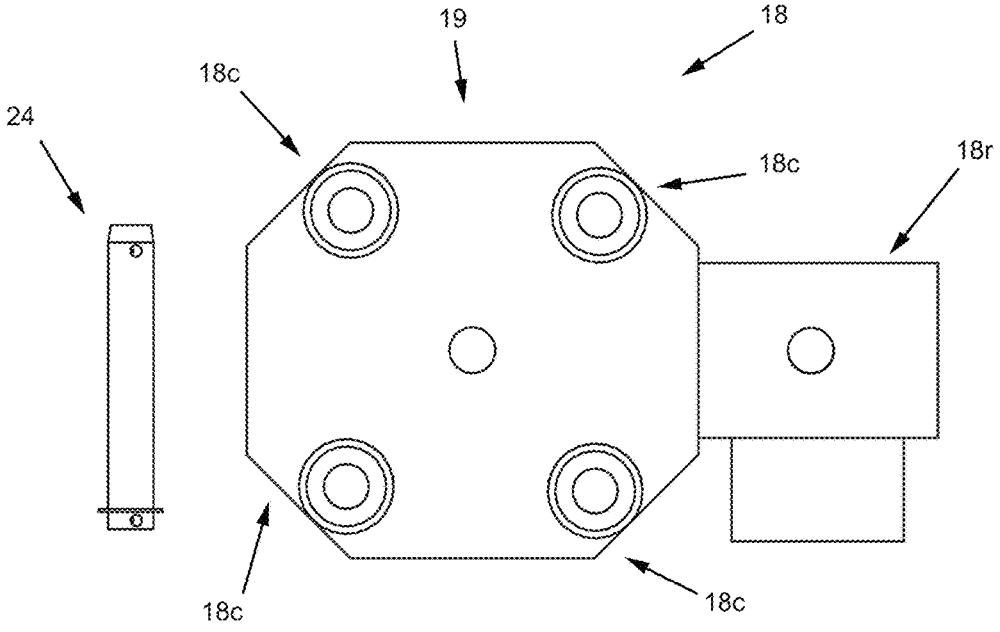
Figure 14:
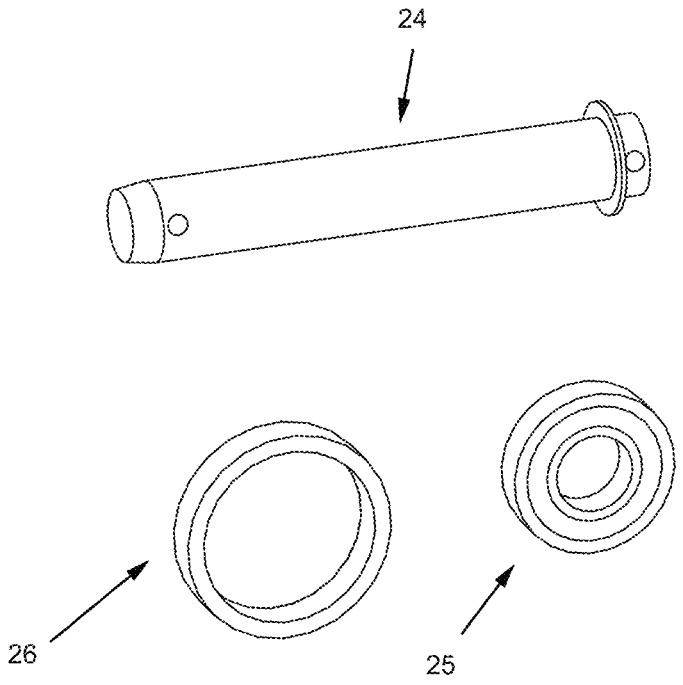
FIG. 14 is a perspective view of roller pins, roller pin bearings and bearing retaining bushing of the embodiment of FIG. 11*a*.

Further unlike the embodiment shown in FIGS. 1-10, sliding member 18 of the embodiment of FIGS. 11*a*-14 preferably has it's corners 18*c* modified (e.g. by removing corner area steel) to allow for a greater range of pivotal motion of sliding member 18 (and boom 16 attached thereto) when pivoting on upright member 14; compare range of motion illustrated in FIGS. 11*a* and 12, with that of FIG. 3. Advantageously, with such greater range of pivoting motion, roller pins 24 can be used to lock sliding member 18 to the upright member when member 18 (and boom 16) is pivoted to into an upright or downward position, i.e. by aligning one or more of the sliding member orifices 18*oa*-18*od* with one or more upright member orifices 14*o* and then placing one or more roller pins 24 through both sets of aligned orifices and, hence, through both sliding member 18 and upright member 14; see FIG. 12 for example. Advantageously, sliding member 18 and boom 16 can then be releasably, securably retained in such upright or downward pivoted position, without the need for the jack 42 to maintain engagement at the interface IF.

Preferably, lifting means 40 of the embodiment of FIGS. 11*a*-14 is provided with a ball-and-socket joint 45 at the interface IF between jack 42 and the receiver portion 18*r*. Advantageously, the ball 45*b* and socket 45*s* of the ball-and-socket joint 45 provides additional stability to the jack's engagement with the sliding member 18 (thereby reducing the risk of jack 42 accidentally disengaging from sliding member 18) while still allowing for significant pivotal motion of sliding member 18 (and boom 16 attached thereto) when pivoting on upright member 14 (see FIG. 11*a*-11*b*). More advantageously, jack 42 can now be safely used to pivot sliding member 18 and boom 16 when sliding member 18 is locked to upright member 14 using security retaining pin 32; see FIGS. 11*a*-11*b*. The embodiment of FIGS. 11*a*-14 preferably further comprises a removable hook H, removably securably on boom 16 at end 16*b* using hook securing pin 16*h* (see FIGS. 11*a* and 12). Advantageously, the engine hoisting assembly 10 can then also be used in a conventional manner to remove engines upward out of an automobile's engine compartment.

Directional terms such as "front", "back", "in", "out", "vertically", "horizontally", "down", "up", "lower", and the like may have been used in the description. These terms are applicable to the embodiments shown and described in conjunction with the drawings. These terms are merely used for the purpose of description in connection with the drawings and do not necessarily apply to all of the positions in which the invention may be used.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. An engine hoisting assembly for supporting an engine, the assembly comprising:
- a ground supporting frame;
- a substantially upright member having a longitudinal axis;
- a boom operably connected to the upright member;
- lifting means to selectively move the boom up or down along upright member's longitudinal axis; and
- engine connecting means to operably connect the boom to said engine;
- wherein the boom is maintained at a substantial horizontal orientation when lifting means selectively moves boom up or down; and
- wherein the substantially upright member is supported by the ground supporting frame.

2. The assembly of claim 1 wherein the boom is of sufficient length to extend substantially over at least a portion of the engine, from one lateral side to another, when said boom is positioned above said engine.

3. The assembly of claim 2 wherein the length of the boom is in a range of 18 to 36 inches.

4. An engine hoisting assembly for supporting an engine, the assembly comprising:
- a ground supporting frame;
- a substantially upright member having a longitudinal axis;
- a boom operably connected to the upright member;
- lifting means to selectively move the boom up or down along upright member's longitudinal axis; and
- engine connecting means to operably connect the boom to said engine;
- wherein the boom is maintained at a substantial horizontal orientation when lifting means selectively moves boom up or down;
- wherein the substantially upright member is supported by the ground supporting frame; and
- wherein the boom is slidably mounted to upright member for slidable movement therealong.

5. The assembly of claim 4 wherein the boom is slidably mounted to upright member via a sliding member having a center.

6. The assembly of claim 5 wherein the sliding member further comprises a receiver portion to receive one end of the boom.

7. The assembly of claim 5 wherein the sliding member further comprises:
- a central passage having a central passage axis to slidably receive upright member therealong; and
- a plurality of rollers disposed within central passage to rollably receive upright member therebetween.

8. The assembly of claim 7 wherein the rollers are removably secured within the central passage.

9. The assembly of claim 7 wherein the sliding member further comprises:
- a plurality of paired corresponding slider member orifices; and wherein the assembly further comprises:
- removable roller retaining pins insertable through said paired corresponding slider member orifices and suitable to keep said plurality of rollers in proper placement within central passage.

10. The assembly of claim 5 further comprising sliding member securing means to securely maintain sliding member at one or more desired preset locations along upright member's longitudinal axis.

11. The assembly of claim 10 wherein the sliding member securing means further comprises:
- a plurality of upright member orifices through upright member at a first axis, said plurality of upright member orifices positioned at regular intervals along the upright member, said first axis being substantially perpendicular to the longitudinal axis of upright member;
- a central orifice through substantially the center of sliding member, said central orifice having a second axis suitable for alignment with the first axis of at least one of said plurality of upright member orifices through upright member; and
- a removable security retaining pin, suitable for insertion through said central orifice and at least one of said plurality of upright member orifices of upright member, when the second axis of central orifice is aligned with the first axis of at least one of said plurality of upright member orifices.

12. The assembly of claim 11 wherein the removable security retaining pin can also function as a pivot pin for the sliding member and the boom.

13. The assembly of claim 5 wherein the sliding member further comprises:
- an outside surface;
- a central passage having a central passage axis to slidably receive upright member therealong; and
- a plurality of paired corresponding slider member orifices; and wherein the assembly further comprises:
- a plurality of roller pins suitable for insertion through said paired corresponding slider member orifices and suitable for rotation against upright member;
- a plurality of roller pin bearings suitable for supporting said plurality of roller pins, with at least one roller pin bearing positioned at each of said paired corresponding slider member orifices; and
- a plurality of bearing bosses secured on the outside surface of the sliding member, each of said bearing bosses suitable to maintain at least one of said plurality of roller pin bearings adjacent a sliding member orifice.

14. An engine hoisting assembly for supporting an engine, the assembly comprising:
- a ground supporting frame;
- a substantially upright member having a longitudinal axis;
- a boom operably connected to the upright member;
- lifting means to selectively move the boom up or down along upright member's longitudinal axis; and
- engine connecting means to operably connect the boom to said engine;
- wherein the boom is maintained at a substantial horizontal orientation when lifting means selectively moves boom up or down;
- wherein the substantially upright member is supported by the ground supporting frame; and wherein the engine connecting means further comprises straps.

* * * * *